United States Patent [19]

Smith

[11] 3,979,028

[45] Sept. 7, 1976

[54] FLUID INJECTOR

[75] Inventor: Paul H. Smith, Hinckley, Ohio

[73] Assignee: Colorflo Limited, Hitchin, England

[22] Filed: Oct. 31, 1974

[21] Appl. No.: 519,513

[52] U.S. Cl. ..... 222/380; 222/496; 101/366

[51] Int. Cl.[2] ..... B41F 31/08

[58] Field of Search ..... 222/379, 380, 378, 496, 222/497; 101/170, 366; 417/444

[56] References Cited

UNITED STATES PATENTS

| | | | |
|---|---|---|---|
| 1,277,842 | 9/1918 | Brinser | 222/378 X |
| 2,689,075 | 9/1954 | Morton et al. | 222/496 X |
| 3,178,082 | 4/1965 | Winders | 222/496 |
| 3,543,682 | 12/1970 | Farrow | 222/379 X |
| 3,912,133 | 10/1975 | Hehl | 222/496 |

*Primary Examiner*—Robert B. Reeves
*Assistant Examiner*—Frederick R. Handren

[57] ABSTRACT

A fluid injector unit wherein fluid from a chamber is deposited through an outlet passage in the chamber and onto a surface through the action of a first piston which moves in the chamber and a second piston which reciprocates within a bore in the first piston. Self sealing valve means are carried by the second piston and operate to urge the second piston toward a closed position in which it closes the outlet passage against fluid flow. Movement of the first piston within the chamber pressurizes the fluid therein and forces the second piston away from the closed position. Sealing means, also carried by the second piston, are then operative to prevent fluid leakage between the second piston and the bore as well as to act as stop means to regulate the range of motion of the second piston away from the closed position.

8 Claims, 2 Drawing Figures

FLUID INJECTOR

BACKGROUND OF THE INVENTION

This application relates to fluid injector units and particularly to fluid injector units of the type where fluid is deposited on a surface through the action of a reciprocating piston. The present invention has particular application to systems in which the regulation of the amount of fluid deposited on a surface by the injector units is of utmost importance, for example, printing systems, gasket making systems, coating systems, etc.

SUMMARY OF THE PRESENT INVENTION

According to the present invention a fluid injector unit is provided with a housing containing a fluid chamber, a first piston movable in the housing and a second piston slidable in a bore in said first piston. The second piston is normally urged into a closed position in which it closes an outlet passage in the housing. Upon pressurization of fluid material contained within the chamber (in the preferred embodiment by movement of the first piston) the second piston is urged away from the closed position, whereupon the fluid may be deposited, via the outlet passage, upon a respective surface to suitable printing plates. The second piston includes sealing means which are operative, upon movement of the second piston away from the closed position to seal the area between the second piston and the bore against leakage of fluid material therethrough. In addition, the sealing means are particularly designed to define a precise range of motion of the second piston away from the closed position, which further contributes to proper regulation of the amount of fluid material which may then be delivered.

DESCRIPTION OF THE DRAWINGS

Other objects and advantages of the present invention will become further evident from the following description and the accompanying drawings wherein.

DETAILED DESCRIPTION OF AN EMBODIMENT OF THE PRESENT INVENTION

As set forth above, the present invention relates to reciprocating fluid injector units, and particularly to those types which may be suitably employed in systems for depositing of material on a base, such as those used for the making of gaskets, for printing purposes, for coating, etc.

Figure 1:
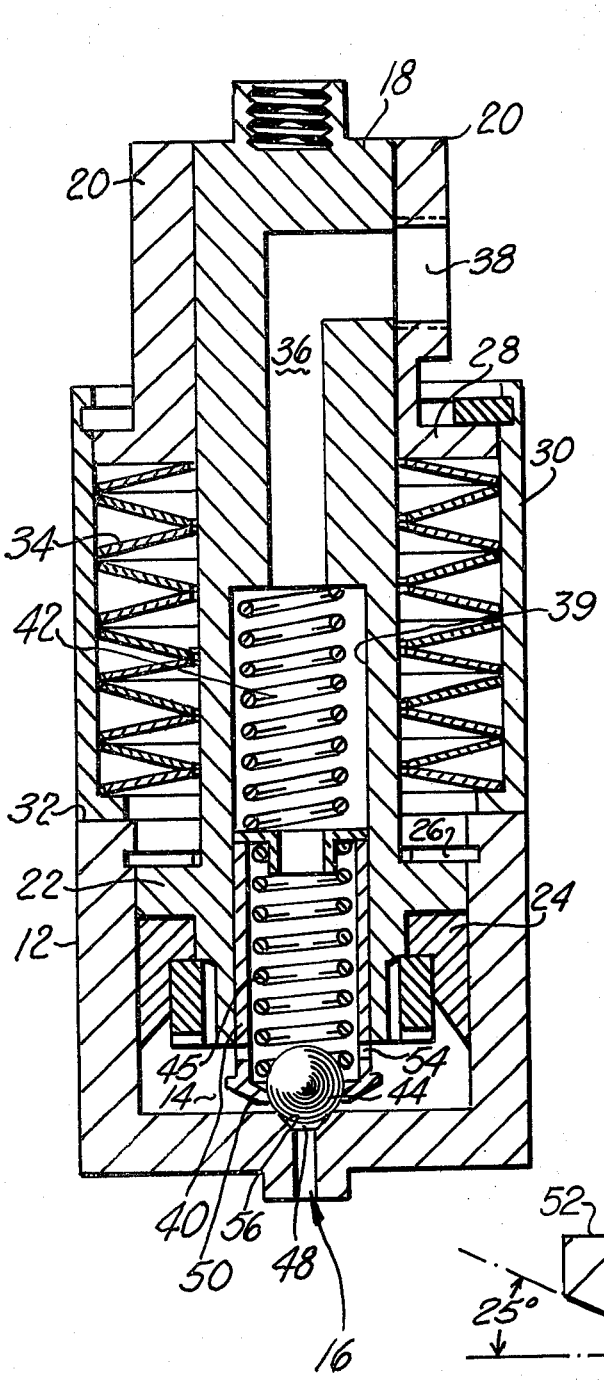
FIG. 1 is a cross-sectional view taken through the fluid injector units which make up the present invention.

In FIG. 1 the injector unit is represented by the numeral 10 and includes housing member 12, the lower portion of which forms or defines a fluid chamber 14. Also, the lowermost portion of the housing member 12 includes a fluid passageway 16 through which fluid from the chamber 14 is deposited upon a surface (not shown). Such a surface might, for example, comprise the surface of an intaglio printing plate. Piston rod 18 is secured to support member 20 and includes a piston 22 which moves in the chamber 14. Piston 22 includes a sliding seal 24 and its range of motion relative to the chamber 14 is limited by stop 26.

Support member 20 includes head 28 which has limited sliding movement in a cylinder 30 whose bottom wall 32 rests upon housing 12. Spring 34 located between head 28 and bottom wall 32 is compressed as pressure is applied to piston rod 18 during printing and thereby acts to apply pressure to the housing member 12.

Piston 22 and its rod 18 are formed with internal passage 36 which communicates with an opening 38 for connection to a supply of fluid. The lower portion of internal passage 36 includes cylindrical bore 39 which opens toward the housing 12 at its lower end, and in which piston 40 is slidably mounted. Piston 40 is biased by spring 42 and includes at its lower end a ball valve 44 which is normally biased, by spring 45, toward the position shown in FIG. 1 in which it closes the outlet passage 48 in the piston. The above-described structure is similar to that disclosed in U.S. Pat. No. 3,543,682 and assigned to the assignee of the present invention.

Figure 2:
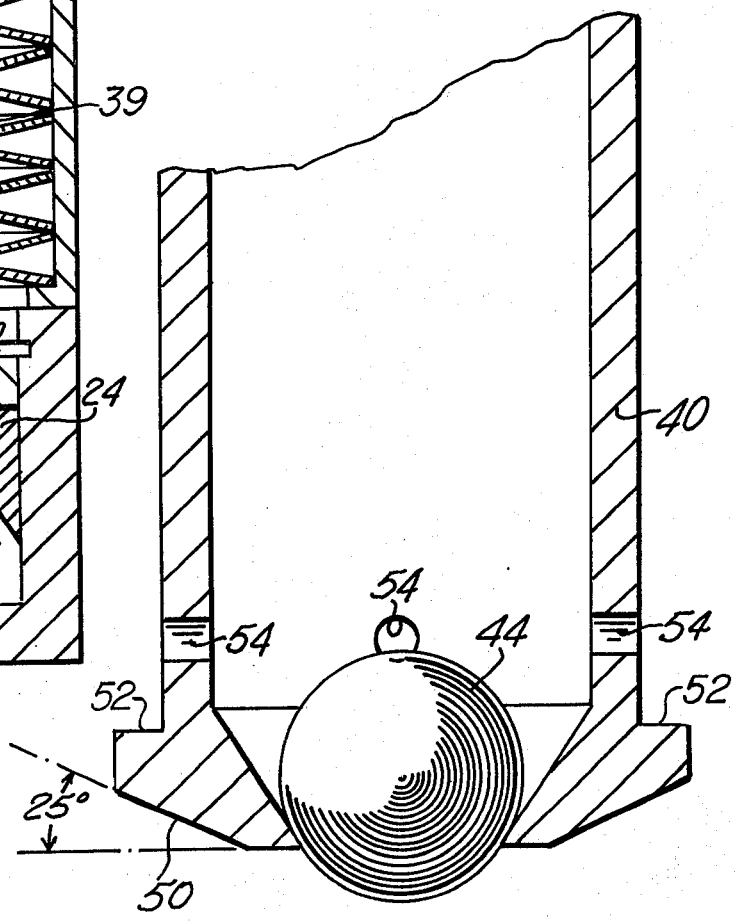
FIG. 2 is an enlarged sectional view of a piston in accordance with the present invention.

Referring now specifically to FIG. 2, the piston 40 includes a lowered tapered nose 50 which preferably tapers at an angle of approximately 25° from the horizontal (as viewed in FIG. 2.). The lower portion of the piston also includes a sealing surface 52 which is substantially in a horizontal plane and which extends substantially around the periphery of the piston. A plurality of chamber inlet openings 54 are disposed slightly above the level of the surface 52. These inlet openings 54, when the piston 40 is in the position shown in FIG. 1, provide a fluid communication between the interior of the piston (which itself is in fluid communication with the printing ink supply through the opening 38) and the chamber 14.

Under the bias of spring 42, the piston 40, along with ball valve 44, acts as a self-sealing valve, which in the absence of substantial fluid pressure within chamber 14, urges piston 40 toward a closed position in which it closes outlet passage 16 against fluid flow. The position shown in FIG. 1 represents the closed position for the fluid injector unit. Outlet passage 16 includes a tapered upper portion 56 which the ball valve substantially closes when the piston is in the closed position. In such position openings 54 are adjacent chamber 14 so that fluid from the ink supplies is in free communication with the chamber 14. During a fluid injecting cycle, pressure is applied by conventional means (not shown) to the piston rod 18 and to the support member 20 and thereby, through the action of spring 34, to the housing 12. Movement of the housing 12 is restricted by a surface (not shown) and this surface is often the very surface upon which the fluid is to be deposited (for example, in a printing apparatus the surface could be that of an intaglio printing plate). With continued downward pressure on the unit, and with the movement of housing 12 blocked by the surface, the pressure on the piston rod 18 moves the piston 22 in the chamber 14 and applies additional pressure to the fluid in chamber 14, as well as cutting off communication between the interior of piston 40 and the chamber 14 by closing the port 54.

As the fluid is pressurized it acts upon both the tapered surface 50 and the surface 52. The tapered surface 50 is sufficiently greater in area than the surface 52, and is also tapered at a shallow-enough angle, so that the pressurization of the fluid in the chamber 14 exerts an upward pressure upon the piston 40, which pressure urges the piston upwardly from the position of FIG. 1 against the bias of spring 39. This permits the fluid in chamber 14 to pass through passage 16 and thereby reach the surface of the printing plate. Should fluid pressure between the piston and outlet passage 16 become excessive, ball valve 44 acts as a relief valve to release fluid into the interior of piston 40.

According to the present invention, the sealing surface 52, upon movement of the piston away from the closed position, contacts the lower portion of the piston 22 and seals the junction between the bore 39 in the piston 22 and the piston 40. In this position the very fluid pressure which would tend to urge fluid into such spaces now tends to urge the surface 52 into a sealing engagement with the lower portion of the piston 22. This tends to eliminate or at least minimize leakage between the piston 40 and the surrounding piston. When fluids of low viscosity are to be injected, this feature has been particularly effective in minimizing leakage. Since the fluid is under considerable pressure it could, in the absence of the surface 52, force its way into the spaces between the piston 40 and the walls of the bore 39 in the piston 22. This would urge the fluid through the passages 54 into the chamber within the piston 40. Such leakage of fluid material, of course, tends to adversely affect the regulation of the pressure within the chamber 14.

Additionally, the surface 52 acts as a stop means in order to limit the amount of motion which is permitted as the piston 40 moves away from the closed position. By thus defining a precise range of motion for the piston 40 the present invention tends to further assure the precise regulation of fluid which is deposited upon the printing surface since the gap between the piston 22 and the passage 16 has a fixed range.

While particularly described as advantageous for the injection of low viscosity fluids it is, of course, contemplated that an injector unit in accordance with the present invention may be advantageously used with numerous types of fluids regardless of their particular viscosity. Of course, it should be readily obvious that while described as a single injector unit a system which employs the present invention would conventionally include numerous injector units of this type, depending upon the particular fluid flow pattern, color pattern, etc., by which the injection system is to be characterized.

Having described the invention, what is claimed is:

1. Apparatus comprising a housing including a chamber, means for conducting fluid material to said chamber, said fluid chamber including an outlet passage, a first piston movable in said chamber, said first piston including means defining a bore, said bore opening toward said chamber, a second piston slidable in said bore, self-sealing valve means carried by said second piston, spring means operative to urge said second piston toward a closed position in which it closes said outlet passage against fluid flow therethrough, means for moving said first piston to a position in which it is operative to apply pressure to the fluid in said chamber, surface means on said second piston and oriented such that the fluid in said chamber operates against said surface and tends, upon pressurization of said fluid, to urge said second piston away from said closed position, and a flange carried by said second piston around the periphery of said second piston having an outer dimension greater than the inner dimension of said bore and operative upon movement of said second piston away from said closed position to act as a sealing means to block fluid flow from said chamber through the spaces between said piston and said bore and to act as a stop means to engage a portion of said first piston which defines said bore, said flange having an effective surface area acted on by the fluid in said chamber upon pressurization of said fluid which is sufficiently less than the effective surface area of said surface means in order to cause said second piston to move away from said closed position.

2. Apparatus as set forth by claim 1 wherein the means for supplying fluid to said chamber includes a fluid passageway within said second piston, a valve between said passageway and said chamber, and means for supplying fluid to said passageway.

3. Apparatus as set forth by claim 2 wherein movement of said second piston away from said closed position is operative to close said valve.

4. Apparatus as set forth in claim 3 and further including pressure relief means carried by said second piston and operative, upon the pressure in said chamber exceeding a predetermined amount, to direct fluid from said chamber into the fluid passageway in said second piston.

5. Apparatus comprising a housing including a fluid chamber having an outlet passage, means for supplying fluid to said fluid chamber, a first piston movable in said chamber and operative to apply pressure to said fluid, said first piston including means defining a bore, a second piston slidable in said bore, said second piston movable between first and second positions within said housing, self-sealing valve means carried by said piston, means operative to urge said second piston toward said first position to close the outlet passage in said housing against fluid flow, and a flange carried by said second piston around the periphery of said second piston having an outer dimension greater than the inner dimension of said bore and operative upon movement of said second piston to said second position to seal the spaces between said second piston and said bore against fluid flow therethrough, said flange being disposed within said chamber and defining means for limiting movement of said second piston away from said outlet passage by engaging a portion of said first piston which defines said bore.

6. Apparatus as set forth in claim 5 wherein said second piston includes means defining a portion shaped in such a manner that pressurizing of the fluid within said chamber is effective to exert a force against said portion which tends to move said second piston from said first position to said second position.

7. Apparatus as set forth in claim 6 wherein said means for supplying fluid to said chamber includes a valve carried by said second piston, movement of said second piston away from said first position being effective to close said valve.

8. Apparatus as set forth in claim 7 wherein said second piston includes a hollow portion and said fluid supplying means is effective to conduct fluid to said hollow portion, said valve includes one or more passages in the walls of said second piston, said passages being adjacent said chamber when said second piston is in said first position, said passages being adjacent the walls of said bore when said second piston is in said second position.

* * * * *